US006041598A

United States Patent [19]

Bliesner

[11] Patent Number: 6,041,598

[45] Date of Patent: Mar. 28, 2000

[54] HIGH EFFICIENCY DUAL SHELL STIRLING ENGINE

[76] Inventor: Wayne Thomas Bliesner, 22521 138 Ave., SE., Snohomish, Wash. 98296

[21] Appl. No.: 08/971,235

[22] Filed: Nov. 15, 1997

[51] Int. Cl.[7] ..... F01B 29/10

[52] U.S. Cl. ..... 60/517; 165/DIG. 342; 220/426

[58] Field of Search ..... 60/517; 220/426, 220/429; 165/104.19, 104.21, 135, 136, DIG. 342, DIG. 348

[56] References Cited

U.S. PATENT DOCUMENTS

| | | | |
|---|---|---|---|
| 3,949,554 | 4/1976 | Noble et al. | 60/521 |
| 4,174,616 | 11/1979 | Nederlof et al. | 60/517 |
| 4,405,010 | 9/1983 | Schwartz . | |
| 4,425,764 | 1/1984 | Lam . | |
| 4,429,732 | 2/1984 | Moscrip . | |
| 4,472,679 | 9/1984 | Inoda et al. . | |
| 4,607,424 | 8/1986 | Johnson . | |
| 4,662,176 | 5/1987 | Fujiwara et al. . | |
| 4,799,421 | 1/1989 | Bremer et al. . | |
| 4,815,290 | 3/1989 | Dunstan | 60/517 |
| 4,832,118 | 5/1989 | Scanlon et al. | 165/164 |
| 4,894,989 | 1/1990 | Mizuno et al. . | |
| 5,074,114 | 12/1991 | Meijer et al. | 60/517 |
| 5,140,905 | 8/1992 | Phar . | |
| 5,217,681 | 6/1993 | Wedellsborg et al. | 220/426 |
| 5,242,015 | 9/1993 | Saperstein et al. . | |
| 5,339,653 | 8/1994 | Degregoria . | |
| 5,355,679 | 10/1994 | Pierce . | |
| 5,383,334 | 1/1995 | Kaminishizono et al. | 60/517 |
| 5,388,410 | 2/1995 | Momose et al. | 60/517 |
| 5,429,177 | 7/1995 | Yaron et al. | 165/10 |
| 5,433,078 | 7/1995 | Shin | 60/517 |
| 5,555,729 | 9/1996 | Momose et al. | 60/517 |
| 5,611,201 | 3/1997 | Houtman | 60/517 |
| 5,715,683 | 2/1998 | Hofbauer et al. . | |

OTHER PUBLICATIONS

Graham Walker 1980 Stirling Engines 151–153.

*Primary Examiner*—Noah P. Kamen
*Attorney, Agent, or Firm*—Dowrey & Associates

[57] ABSTRACT

A stirling engine which uses a dual pressure shell surrounding the high pressure and temperature engine components. Space between the shells is filled with an incompressible and insulating liquid material, such as a liquid salt. The liquid may have a filler material to prevent excessive movement. The liquid provides a time varying pressure field, driven by the pressure variations in the Stirling engine working fluid, which cancels the pressure differential on heat transfer tubing. The heat transfer tubing is inside of a dome which contains an incompressible, highly thermally conductive liquid, such as Sodium. The combination described allows a Stirling engine to operate at significantly higher temperatures and pressures relative to existing technology.

27 Claims, 2 Drawing Sheets

HIGH EFFICIENCY DUAL SHELL STIRLING ENGINE

BACKGROUND

1. Field of the Invention

This invention relates to Stirling Engines, specifically to:

1. Improvements in maximum operating temperatures.
2. Improvements in the regenerator to maximize performance.
3. Improvements in a throttling system designed for low cost and maximum performance
4. Improvements in high pressure shaft sealing to allow external drives.

2. Prior Art

A patent search was made investigating the types of improvements in Stirling Engines which have been accepted for United States Patents over the last 10 years. The author has researched the technologies over the last 50 years to understand the development of the state of the art for Stirling engines used as power systems.

Stirling engine performance improvements are continually being sought to increase the benefit of these energy conversion devices and allow large scale commercial introduction into the marketplace. Cost reduction has also been a key research area for these engines due to their increased complexity over open cycle engines such as the Internal Combustion and Brayton engines which have achieved extensive commercialisation success.

The maximum Stirling engine efficiency is related to the Carnot efficiency which is governed by the ratio of maximum working fluid temperature relative to the minimum fluid temperature. Improvements in technologies which increase the margin between the two temperature extremes is beneficial in terms of total cycle efficiency. The lower working fluid temperature is typically governed by the surrounding air or water temperature; which is used as a cooling source. The main area of improvements result from an increase in the maximum working temperature. The maximum temperature is governed by the materials which are used for typical Stirling engines. The materials, typically high strength Stainless Steel alloys, are exposed to both high temperature and high pressure. The high pressure is due to the Stirling engines requirement of obtaining useful power output for a given engine size. Stirling engines can operate between 50 to 200 atmospheres internal pressure; for high performance engines.

Since Stirling engines are closed cycle engines the heat must travel through the container materials to get into the working fluid which typically are made as thin as possible to maximize the heat transfer rates. The combination of high pressures and temperatures has limited Stirling engine temperatures to around 800 Centigrade. Ceramic materials have been investigated, as a technique to allow higher temperatures, however the brittleness and high cost have made them difficult to implement.

The Stirling engine U.S. Pat. No. 5,611,201 to W. Houtman (filed Sep. 29, 1995) shows an advanced Stirling engine based on Stainless Steel technology. This engine has the high temperature components exposed to the large pressure differential which limits the maximum temperature to the 800° C. range. U.S. Pat. No. 5,388,410 to Yutaka Momose, Anjo; Tetsumi Watanabe, Okazaki; and Hiroyuki Ohuchi, Toyoake (filed Feb. 14, 1995) shows a series of tubes, labelled part number 22 a through d, exposed to the high temperatures and pressures. The maximum temperature is limited by the combine d effects of the temperature and pressure on the heating tubes. U.S. Pat. No. 5,383,334 to Takeyoshi Kaminishizono, Chiryu; Tetsumi Watanabe, Okazaki; Yutaka Momose, Anjo (filed Jan. 24, 1995) again shows heater tubes, labelled part number 18, which are exposed to the large temperature and pressure differentials. U.S. Pat. No. 5,433,078 to Dong K. Shin; Kyungki (filed Jul. 18, 1995) also shows the heater tubes, labelled part number 1, exposed to the large temperature and pressure differentials. U.S. Pat. No. 5,555,729 to Yutaka Momose; Koji, Fujiwara; Juniti Mita (filed Sep. 17, 1996) uses a flattened tube geometry for the heater tubes, labelled part number 15, but is still exposed to the large temperature and pressure differential. The flat sides of the tube add additional stresses to the tubing walls. U.S. Pat. No. 5,074,114 to Roelf Meijer, Ernst Meijer, and Ted Godett (filed Dec. 24, 1991) also shows the heater pipes exposed to high temperatures and pressures.

The next item, in the Stirling engines, which is critical to the maximum performance is the regenerator. This device must heat and cool the working fluid for each cycle of the engine which may be 20 to 100 times per second. The regenerators which have been, typically, used in the past have been mesh screen type regenerators. The regenerators are a very dense packing of fine mesh screens into layers which are 100's of screens thick. The fine screens and multiple layers are required to transmit the heat at the very high rate requirements. These screen regenerators have significant pressure drop as the working fluid, typically Helium, Hydrogen, or Air, moves through the mesh at high speeds. The performance of the Stirling engine is thusly limited by the use of mesh screens. For very small Stirling engines a single annular slot has been used with success. The slot reduces the pressure drop but is limited by the amount of surface area in a single slot regenerator. U.S. Pat. No. 5,388,410 to Yutaka Momose, Anjo; Tetsumi Watanabe, Okazaki; and Hiroyuki Ohuchi, Toyoake (filed Feb. 14, 1995) shows the mesh regenerator located inside the heating and cooling tubes; labelled part number 25. An improvement to this design is shown in this patent as part number 26. This patent uses a series of small annular pipes placed inside the heater pipe. The maximum heat transfer rate is limited by the minimum pipe diameter. The small tubes also touch each other on their exterior which blocks the working fluid flow.

Throttling of Stirling engines is typically accomplished by varying the amount of working fluid inside the engine. With this technique a significant amount of pumping and valving hardware is required to move the working fluid. This is complicated by the high working pressures which increases the size of the pumping hardware. A second technique to throttle the Stirling engine involves opening ports within the engine which are connected to dead volumes. This technique increases the total system volume which lowers the power but also results in a significant reduction in efficiency due the larger dead volume which the engine is exposed to for the entire piston stroke. U.S. Pat. No. 5,611,201 to W. Houtman (filed Sep. 29, 1995) and U.S. Pat. No. 5,074,114 to Roelf Meijer, Ernst Meijer, and Ted Godett (filed Dec. 24, 1991) are unique in the use of a variable angle plate connected directly to each piston. Reducing the plate angle results in reduced movement of the piston resulting in reduced power levels. The throttling technique, using the plate angle, has the disadvantage of a higher system weight due to the large loads generated when converting the wobble motion of the plate to torque.

A further feature, which has been a significant problem for Stirling engines, is the sealing system. If a Stirling engine with a pressurized crankcase has an output shaft which is outside of the pressure shell it must deal with the sealing problem at the crankshaft. Working fluid leakage, at the seals, is a large problem for external shaft systems. The seal problem is overcome by placing a generator or pump inside of the Stirling engine housing. This technique eliminates the high pressure rotating seal. The rotating seal is easier to seal relative to a sliding seal. A pressurized crankcase eliminates the need for a perfect sliding seal but requires the rotating seal. The disadvantages to the high pressure seal include the high cost and potential requirement to replace working fluid in the engine. The high pressure seals have limited lifetimes which requires replacement of the seal.

OBJECTS AND ADVANTAGES

Accordingly, several objects and advantages of my invention are:

A Stirling engine which offers significantly increased efficiency over the prior art. Efficiencies which are 20% higher than prior art are anticipated. This has direct benefit in terms of reduced: fuel consumption, engine size, weight, and cost. The high efficiency is achieved through a combination of two main features: a dual shell containment system and an improved annular regenerator.

The dual shell containment system provides a time varying pressure field which matches the internal pressure fluctuations in the engine. The pressure field significantly reduces the pressure differential on the high temperature heat transfer piping. The lower pressure differential allows the heat transfer piping to operate at significantly higher temperatures resulting in a direct improvement in efficiency.

The improved regenerator is designed to absorb the same heat quantities as a mesh regenerator but without the large pressure drop associated with the mesh system. The annular regenerator has the further advantage of operating with a reduced frontal area, relative to the mesh system. The advantage of the reduced frontal area is that the area of the annular regenerator more closely matches the heater tube and cooling tube areas. This eliminates the losses associated with the convergent and divergent ducting regions generally required on large regenerator area systems. The elimination of the convergent and divergent ducting regions further improves the engine by reducing the dead volume in the Stirling engine. Reductions in dead volume provide improvements in power level and increases in system efficiency. The current regenerator embodiment uses a Graphite fiber combined with a carbon matrix. The graphite has a preferred fiber orientation, circumfirential, which allows a 100 to 1 conductivity increase in the circumfirential direction relative to axial. An optimum regenerator would have zero axial thermal conductivity and a very high circumfirential conductivity.

The Stirling engine, shown in this patent, has a further improvement in a simplified throttling system. The new system provides high efficiency at reduced power levels. It also provides an extremely light weight, simple, and low cost system for varying the power level in the engine. The system has the further advantage of not requiring extensive plumbing and pumping systems which are prone to leaks.

The next advantage of this new Stirling engine design is the dual chamber sealing system. This new system eliminates the working fluid losses by providing a buffer chamber filled with air, at the external seal, which can be maintained at pressure using pumped ambient air.

LIST OF REFERENCE NUMERALS

Figure 1:
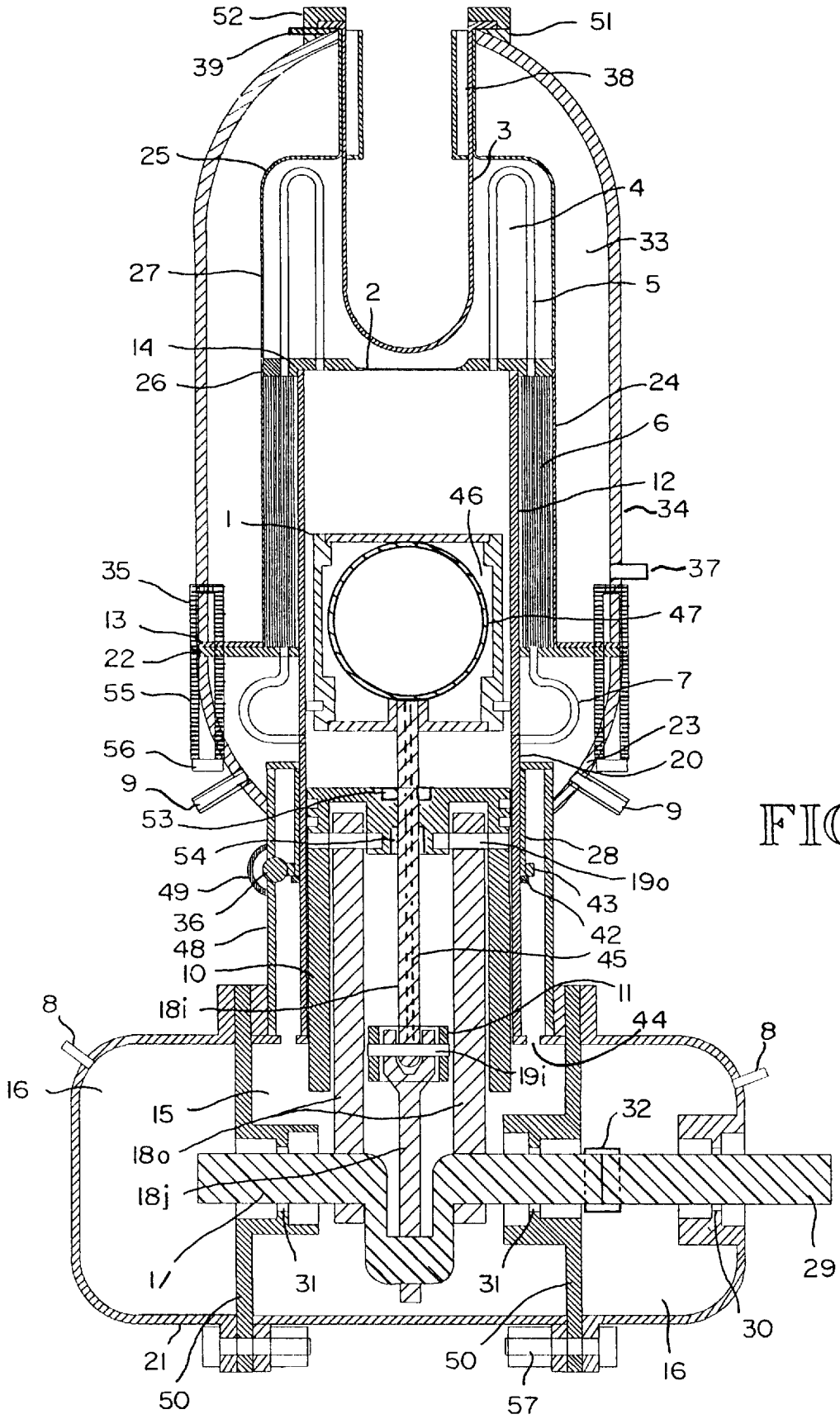
FIG. 1 is a longitudinal vertical cross sectional view showing the overall arrangement for a complete Stirling engine system.

| Part Number | Part Name | Part Number | Part Name |
|---|---|---|---|
| 1 | Displacer Piston | 31 | Low Pressure Seals & Bearings |
| 2 | Expansion Bellows | 32 | Shaft Fitting |
| 3 | Heater Tube | 33 | Liquid Salt Region |
| 4 | Liquid Metal Region | 34 | Salt Shell |
| 5 | Heat Transfer Tubing | 35 | Upper Shell Attachment Fitting |
| 6 | Graphite Regenerator | 36 | Throttle Control Worm |
| 7 | Cooling Pipes | 37 | Salt Port |
| 8 | Air Pump Fitting | 38 | Heater Tube Insulation |
| 9 | Cooling Fluid Port | 39 | Liquid Metal Port |
| 10 | Power Piston | 40 | Cylinder Ports |
| 11 | Rod Guide | 41 | Throttle Ports |
| 12 | Regenerator Insulation | 42 | Throttle Collar |
| 13 | Outer Flange | 43 | Worm Gear |
| 14 | Snug Fit Joint | 44 | Throttle Vent |
| 15 | Helium Chamber | 45 | Displacer Vent |
| 16 | Air Chamber | 46 | Displacer Salt Region |
| 17 | Crankshaft | 47 | Displacer Internal Sphere |
| 18i | Upper Connecting Rod | 48 | Throttle Housing |
| 18j | Lower Connecting Rod | 49 | Throttle Blister Housing |
| 18o | Outer Connecting Rods | 50 | Crankshaft End Plates |
| 19i | Center Connecting Pin | 51 | Salt Shell Fitting |
| 19o | Outer Connecting Pins | 52 | Salt Shell Cap |
| 20 | Cylinder | 53 | Power Piston Seal |
| 21 | Lower Housing | 54 | Power Piston Axial Bearing |
| 22 | Cooling Flange | 55 | Lower Shell Attachment Fittings |
| 23 | Cooling Housing | 56 | Shell Bolts |
| 24 | Outer Shell | 57 | Lower Housing bolts |

-continued

| Part Number | Part Name | Part Number | Part Name |
|---|---|---|---|
| 25 | Dome | 58 | Ceramic String |
| 26 | Dome Plate | | |
| 27 Pressure Shell Assembly | | | |
| 28 | Throttle | | |
| 29 | Output Shaft | | |
| 30 | High Pressure Seal and Bearing | | |

SUMMARY OF INVENTION

The Stirling engine described in this patent is unique in its use of an insulating dual shell containment system. The outer shell provides a time varying pressure field which significantly reduces the pressure differential on the critical high temperature components allowing the engine to operate at significantly higher temperatures. The shell is filled with a liquid material which provides an insulating and approximately incompressible region. The liquid has a fiber material dispersed throughout the shell to prevent convection currents in the liquid.

A second unique feature is the annular regenerator which provides the required heat transfer characteristics with reduced pressure losses through the matrix. The regenerator has the additional benefit of using a material with preferential thermal conductivity in the direction perpendicular to the flow direction. This allows maximum heat absorption at a given regenerator location and minimal heat loss through conduction along the axial direction.

A third unique feature of the Stirling engine design involves the throttling system. The throttle provides a simple and robust mechanism for efficiently operating the engine at partial throttle. The throttle design uses a series of venting ports located along the travel of the power piston. The ports can be selectively vented to the lower housing thereby reducing the power output.

A fourth unique feature involves the dual chamber seal system. The system isolates the working fluid in an inner chamber preventing fluid losses. The outer chamber is pressurized with the ambient environment so that it can be repumped with outside gasses.

DESCRIPTION—MAIN EMBODIMENT

The drawing in FIG. 1 shows a longitudinal sectional view of the Stirling engine system. The view indicates the overall integration of the unique features of this design.

The Stirling engine shows a dual piston arrangement connected directly to a crankshaft(17). The top piston is a displacer piston(1) and the bottom piston is a power piston (10). The displacer piston(1) is approximately 60 to 120 degrees out of phase with the power piston(10). The design is set-up to produce power from a supplied heating and cooling source. The phase angle, between the two pistons is set-up so that as the power piston(1) is reaching top dead center the displacer piston(1) is moving down. The displacer phase is therefore leading the power phase by the 60 to 120 angle. FIG. 1 shows the displacer piston(1) with a set of two rods connected in series. The rod connecting to the displacer piston(1) is an upper connecting rod(18*i*). The rod connecting from the upper connecting rod(18*i*) to the crankshaft(17) is a low connection rod(18*j*). The Power piston(10) has a set of two identical outer connecting rods(18*o*) both of which are attached to the power piston(10) with a set of connecting pins(19*o*) and the crankshaft(17). The upper connecting rod(18*i*) passes through a rod guide(11) which keeps the upper connecting rod(18*i*) in a purely vertical motion at the pistons. The upper connecting rod(18*i*) has a connecting pin(19*i*), which is attached to the rod guide(11). The two pistons move vertically inside a cylinder(20). Piston rings are shown on each piston. Both the power piston(10) and the rod guide(11) have axial bearings, not shown, mounted on the side flanges. The power piston(10) has a set of axial bearings, in at least three locations around the piston flange, which roll on the cylinder(20). The rod guide(11) has a set of two axial bearings, located on the front and back side in FIG. 1, which ride on the inside wall of the power piston (10). The crankshaft(17) is designed to allow bearings to slide over the shaft end and to the appropriate locations where they attach with the connecting rods(18*j* and 18*o*). The power piston(10) has a power piston seal(53) and a power piston axial bearing(54) located inside the power piston(10). The upper connecting rod(18*i*) rides in the seal (53) and bearing(54).

The cylinder(20) is attached directly to a lower housing (21) and forms a sealed unit; except for the top of the cylinder. The lower housing(21) consists of a central section and a set of two crankshaft end plates(50). The two crankshaft end plates(50) are bolted at the flange locations to the central section using a number of lower housing bolts(57). The lower housing(21) can be set-up with or without an output shaft(29). The lower housing(21) contains a working fluid, Helium, in the center housing. A buffer fluid air; is in the chamber next to a high pressure seal and bearing(30). The separate air chamber is added to ease the sealing problem with the output shaft(29) going from a high pressure Helium chamber(15) directly to the ambient air. A set of air chambers(16) are held at approximately the same pressure as the Helium. This allows a simple low pressure seal and bearing(31) between the Helium and air chambers. The engine could use both air chambers(16) or it could have only the air chamber with the output shaft(29). In this case the left chamber would be connected to the Helium chamber (15). The high pressure seal and bearing(30) holds the large pressure differential between ambient conditions and the air chamber(16). The advantage is that a small air pump can be attached to an air pump fitting(8) and easily maintain the pressure loss due to a slow leakage rate at the high pressure seal and bearing(30). The lower housing could use both external and internal power output systems. A generator, not shown, represents a typical device which could be internally attached to the crankshaft(17) at a shaft fitting(32).

Since the crankshaft(1) bearings are sealed against the Helium, in the air chambers(16), it is possible to use oil in the air regions to lubricate the three bearings. The flanges located on either end of the lower housing(21) allow access to the bearings and crankshaft region.

A throttle(28) is shown around the cylinder(20). The throttle(28) rides on a throttle collar(42). The throttle(28)

has sets of staggered holes arranged around the perimeter which line-up with holes in the cylinder(20) depending on the position of the throttle(28). A worm gear(43) is attached to the throttle(28). A throttle control worm(36) is attached to the worm gear(43). A throttle housing(48) encloses the throttle(28) and is attached to the lower housing(21) at the bottom and to the cylinder(20) at the top. A throttle housing blister(49) is located on the throttle housing(48) and surrounds the throttle control worm(36). An internal or external drive can be attached to the throttle control worm(36). A throttle vent(44) consists of a series of holes located in the lower housing(21).

The top of the cylinder(20) is capped with a pressure shell assembly(27). The pressure shell assembly(27) consists of an outer flange(13) which bolts to a cooling flange(22) at a number of upper shell attachment fitting(35) locations. The upper shell attachment fittings(35) are bolted to a set of lower shell attachment fittings(55) using a set of shell bolts(56). The outer flange(13) is welded to an outer shell (24). Both a Dome(25) and an outer shell(24) are welded to a dome plate(26). These four welded pieces form the pressure shell assembly(27). This pressure shell assembly(27) forms a tight removable joint with the cylinder(20) at a snug fit joint(14).

The cooling flange(22) attaches to the pressure shell assembly(27) at the outer flange(13). A cooling housing(23) consists of a outer jacket which is attached at the bottom to the throttle housing(48). The cooling housing(23) is also attached to the cooling flange(22). The cooling flange(22) is attached to the cylinder(20). The cooling housing(23) has a set of two cooling fluid ports(9) shown on opposite sides of the cooling housing(23).

With the cooling housing(23) and the pressure shell assembly(27) attached together over the cylinder(20) a completely sealed vessel is formed. A gasket is used between the outer flange(13) and the cooling flange(22).

The cooling housing(23) is shown with a set of cooling pipes(7) brazed from the cooling flange(22) to the cylinder (20). The number, size, and length of cooling pipes(7) varies with different engine sizes.

The pressure shell assembly(27) has a set of heat transfer tubing(5) located inside of the dome(25). The heat transfer tubing(5) are welded to the dome plate(26) at two locations for each tube. All of the heat transfer tubing(5) have one end welded to the region which is directly above the cylinder (20). The second end of the heat transfer tubing(5) is welded above the annulus formed between the outer shell(24) and the cylinder(20). The number, size, and length of heat transfer tubing(5) varies with different engine sizes. The dome plate(26) has an expansion bellows(2) located inside of the dome(25) and machined or attached to the dome plate(26). The pressure shell assembly(27) also has a heater pipe(3) attached through the dome(25). The position, number, and size of the heater pipes is determined by the specific engine requirements. The region between the dome (25) and the dome plate(26) is filled with a liquid metal region(4) which completely fills the cavity. Sodium is a usable high conductivity liquid metal over the engine operating range.

A Salt Shell(34) surrounds the Pressure shell assembly (27). The salt shell(34) contains a low melting point salt mixture which remains a liquid over the operating temperature of the salt shell(34) and the pressure shell assembly(27). A workable salt for this region would be Boron Anhydride or a mixture of Boron Anhydride and Bismuth Oxide. A filler material such as a ceramic fiber or similar material is placed in a liquid salt region(33). The salt shell(34) has a reinforcing salt shell fitting(51) attached at the top where the heater tube(3) attaches. The heater tube(3) is shown as a single tube which is sealed at the bottom and is attached to the salt shell fitting(51) at the top. A salt shell cap(52) attaches to the salt shell fitting(51). A heater tube insulation(38) is located inside the heater tube(3) and separates the salt region from the heater tube(3). Both the Dome(25) and Salt Shell(34) have access ports for filling and draining fluids. The liquid metal is accessed through a liquid metal port(39). The liquid salt is accessed through a salt port(37).

The region between the outer shell(24) and the cylinder (20) is fill with a graphite regenerator(6). The graphite regenerator(6) is a separate piece of material which can be removed from the pressure shell assembly once the outer flange(13) is disconnected. The graphite regenerator(6) consists of a coiled annulus of graphite fibers which have been heated to remove the resins which are converted to a carbon material. The coil is made by laying up a prepreg uni-axial graphite tape, at a small helix angle relative to perpendicular, on a non-stick backing material; such as a Boron Nitride coated steel coil. The steel coil may be only 0.01 inches thick, a little wider than the regenerator length and several feet long. The helix angle is variable but is assumed to be 5 to 15 degrees. A second layer of prepreg uni-axial graphite tape is applied over the first layer but with the helix 5 to 15 degrees off perpendicular in the other direction. The resulting lay-up of graphite fibers would have the fibers running approximately + or −15 degrees relative to perpendicular. In FIG. 1 perpendicular would be a direction which is from left to right or right to left. The graphite regenerator(6) is represented in FIG. 1 as a series of vertical lines. The graphite fiber lay-up would be like a loose roll of paper which is wrapped around the cylinder(20). Perpendicular would then be the long direction of the roll of paper. Once the two layers of graphite fiber are cured and baked to form a Carbon—Carbon matrix they are unwrapped from the steel coil and formed into a loose coil which is annular in shape. Spacers are put between each layer of graphite to maintain an annular gap between each layer. A low thermal conductive material can be used as the spacer; such as a ceramic string(58). The graphite regenerator(6) is placed inside the pressure shell assembly(27) and assembled. A layer of insulation is placed between the regenerator(6) and the cylinder(20) forming a regenerator insulation(12).

The displacer piston(1) is shown attached to the upper connecting rod(**18*i*) at the bottom of the piston. A small displacer vent(45) is shown inside of the upper connecting rod(18*i*). The displacer piston(1) is shown with a displacer internal sphere(47) located inside. The displacer vent(45) is connected to the displacer internal sphere(47). A displacer salt region(46**) fills the region between the sphere and the piston. The salt has a filler material in the same region as the salt. The filler material could be a ceramic mat or similar substance.

Figure 2:
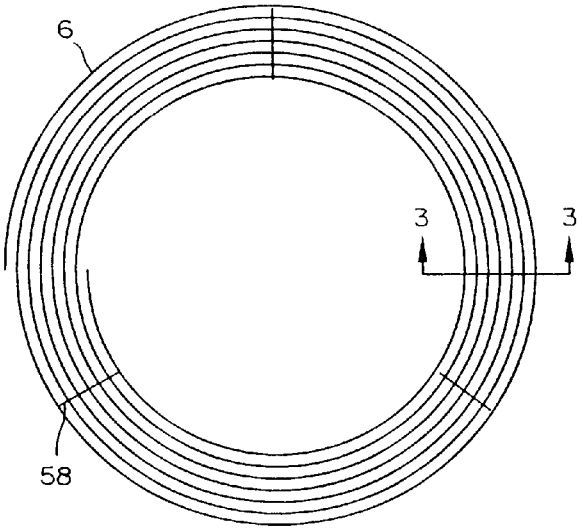
FIG. 2 is a top plan view of a spiral wrapped annular regenerator.

FIG. 2 shows a top view of the coiled graphite regenerator (6). The graphite regenerator(6) consists of one or more layers of graphite fiber with a carbon matrix holding the layers together and adding rigidity. The ceramic string(58) is woven through the regenerator at a minimum of three locations, with one string at each location.

Figure 3:
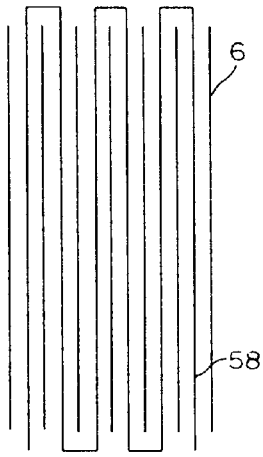
FIG. 3 shows a side view taken along lines AA of FIG. 2.

FIG. 3 shows a side elevational view of the regenerator as a cut through section AA. The ceramic string(58) is woven as single length of string through each layer of the regenerator. The ceramic string(58) provides the spacing for the graphite channel.

Figure 4:
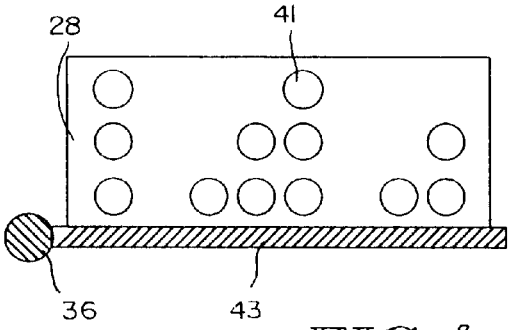
FIG. 4 is a side elevational view of the throttle ring assembly. The assembly is the movable component of the throttle system.

FIG. 4 shows the throttle ring assembly in side view. The assembly consists of the throttle(28) which is attached to the worm gear(43). The throttle control worm(36) is shown attached to the worm gear(43). A series of ports(41) are drilled through the throttle(28) and are set to match holes in the cylinder(20). A blank space separates each set of ports (41) which run around the throttle(28).

Figure 5:
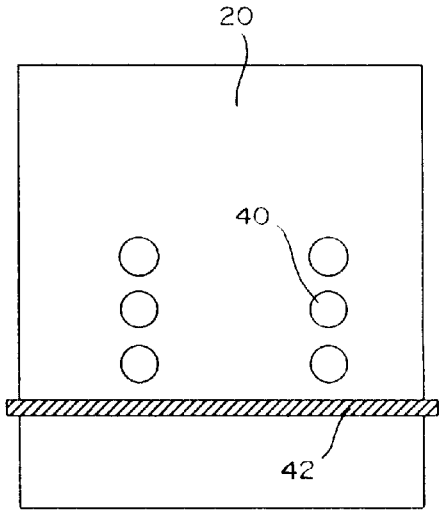
FIG. 5 is a side elevational view of a section of the cylinder in the region of the throttle.

FIG. 5 shows a side elevational view of the cylinder throttle assembly. The assembly consists of the cylinder(20), a throttle collar(42), and a set of cylinder ports(40). The throttle(28) rides on the throttle collar(42). The cylinder ports(40) are drilled so that sets of holes can be opened between the cylinder(20) and the throttle housing(48).

OPERATION—MAIN EMBODIMENT

Working Fluid Movement

The operation of the Stirling engine, in FIG. 1, is described below. The Stirling engine can be run to produce either power out or as a heat pump providing cooling. The difference is determined by whether the displacer phase angle is ahead of or behind the power piston. FIG. 1 shows an engine designed to produce rotary shaft power. The cylinder(20) is attached to the lower housing(21) and contains both the power piston(10) and the displacer piston(1). To produce shaft power the displacer piston(1) is attached, through the set of connecting rods(18*i* and 18*j*), to the crankshaft(17) at an angle which is 60 to 120 degrees ahead of the set of outer connecting rods(18*o*) and power piston (10). The lower piston, the power piston(10), provides the power to the crankshaft(17).

The upper piston, the displacer piston(1), is driven by the crankshaft(17) and provides the means to move the working fluid between the chamber directly below the displacer piston(1) and the chamber directly above the displacer piston(1). To move from the region below the displacer piston(1) to the region above the displacer piston(1) the working fluid must be forced, by the action of the displacer piston(1) moving down, to move through the set of cooling pipes(7) through the graphite regenerator(6) and through the set of heat transfer tubing(5). To move the working fluid from the region above the displacer piston(1) to the region below the displacer piston(1) the working fluid must be forced, by the action of the displacer piston(1) moving upwards, to move from the heat transfer tubing(5) through the graphite regenerator(6) and through the cooling tubes(7). The function of the heat transfer tubing(5) is to move heat from the liquid metal region(4) into the working fluid. The function of the cooling pipes(7) is to move heat from the working fluid into the cooling fluid which is located inside the cooling housing(23).

Piston Operation

The power piston(10) and the displacer piston(1) are sequenced to the crankshaft(17) by the inner and outer connecting rods(18*i*, 18*j*, 18*o*). Two outer connecting rods (18*o*) transmit the power from the power piston(10) with the set of connecting pins(19*o*) providing a rotating joint at the power piston(10). A bearing is located at each end of the outer connecting rods(18*o*) to minimize friction.

The displacer piston(1) is attached to the upper connecting rod(18*i*) with a rigid connection. The displacer is shown with the displacer internal sphere(47) which is vented to the Helium chamber(15) by the displacer vent(45). The sphere provides a structurally efficicant low thermal region between the top and bottom of the displacer piston(1). The displacer vent(45) maintains the sphere at the Helium chamber(15) pressure. The displacer salt region(46) is shown between the displacer internal sphere(47) and the displacer(1). The displacer internal sphere(47) can be filled with an insulation material or reflective foil to minimize heat loss across the sphere. The displacer salt region(46) also has a filler material which minimizes heat loss by reducing the movement of the liquid salt.

The power piston seal(53) is shown pressed into the top of the power piston(10). The power piston axial bearing(54) is shown pressed into the bottom of the power piston(10). Both the seal and bearing have the upper connecting rod (18*i*) passing through at the power piston(10) and are used to minimise working fluid movement and provide reduced friction between the power piston(10) and the upper connecting rod(18*i*).

The lower connecting rod(18*j*) is pinned to the upper connecting rod(18*i*) with the connecting pin(19*i*). The pin is necessary due to the vertical motion of the rod(18*i*) and the swinging motion of the rod(18*j*). The outer connecting rod junction has the rod guide(11) which surrounds the junction and is connected using the connecting pin(19*i*). The rod guide(11) maintains the vertical alignment of the rod(18*i*). The rod guide(11) has two axial bearings, not shown, which are located between the outer edge of the rod guide(11) and the inside of the power piston(10). Roller bearings are located on the ends of both the upper and lower connecting rods(18*j*). The power piston(10) also has a set of at least three axial cylinder bearings located on the outer surface of the power piston(10). The axial bearings roll on the inside wall of the cylinder(20). The complete assembly is lubricated with dry Boron Nitride powder.

Graphite Regenerator Function

The function of the graphite regenerator(6) is to efficiently heat the working fluid as the working fluid moves from the cooling pipes(7) to the heat transfer tubing(5). The graphite regenerator(6) also functions to cool the working fluid as the working fluid moves from the heat transfer tubing(5) to the cooling pipes(7). A way to picture the function of the graphite regenerator(6) is to visualize the graphite regenerator(6) as a series of narrow constant temperature heat sink regions stacked on top of one another inside the graphite regenerator(6). The temperature of the top of the regenerator is at the liquid metal region(4). The temperature at the bottom of the regenerator is at the cooling fluid temperature. If the working fluid were to flow very slowly through the narrow constant temperature regions so that the working fluid adjusts its temperature to match the local regenerator temperature; and if the working fluid accomplished this without a pressure drop as it passed through the regenerator; then a perfect regenerator would be described which minimizes the losses as the working fluid gets moved between the regions above and below the displacer piston (1). The regenerator thus needs to have very low thermal conductivity in the fluid flow direction; since one end of the regenerator is hot and the other end is cold. The regenerator also needs to have very high thermal conductivity in the direction normal to the fluid flow so that the working fluid can rapidly adjust itself to the local temperature inside the regenerator. The regenerator must also have a very large surface area to improve the rate of heat movement with the working fluid. Finally the regenerator must have a low loss flow path, for the working fluid, so that minimal pressure drop will result as the working fluid moves through.

Engine Operation

The engine operates by supplying heat to the heater pipe(3) and cooling with the set of cooling fluid ports(9). A rotary motion is imparted to the crankshaft(17) by some means. Once the Stirling engine starts to spin it is self sustaining. The motion causes the power piston(10) to produce power to the crankshaft(17). The displacer piston(1) forces working fluid back and forth between the top of the displacer piston(1) and the dome plate(26) or the region between the two pistons. The working fluid must pass through the heat transfer tubing(5), cooling pipes(7), and the regenerator(6) in the process.

The graphite regenerator(6) is unique to other regenerators in its use of a material, graphite fibers, which have a thermal conductivity which is significantly higher in the fiber direction i.e. along the longitudinal axis. Graphite has over 100 times the conductivity in the fiber direction relative to the direction perpendicular to the fiber which consists of a carbon matrix. In the design in FIG. 1 the graphite fibers run almost 90 degrees to the fluid flow. This gives a very high thermal conductivity around the helix but very low conductivity in the fluid direction. The benefit of this differential thermal behaviour is tied to the requirements of the regenerator. The top of the regenerator is at a very high temperature while the bottom of the regenerator is at a lower temperature. The regenerator operates more efficiently with very low conductivity in the fluid direction; i.e. up or down. The large heat transfer rates perpendicular to the fluid direction allow the fluid to transfer energy to and from the regenerator efficiently. The fiber orientation away from perpendicular was done to increase the strength of the coil. Individual graphite coil layers may be less than 0.01 inches thick with a gap between coil layers around 0.005 inches. The benefit of a helix, as opposed to other regenerator systems such as screens, is the reduced pressure drop which occurs in the helix relative to other systems. This increases the total Stirling engine efficiency while allowing very high heat transfer rates. Graphite was chosen for its high temperature and strength characteristics which make it ideal as a regenerator material. It also has a very low coefficient of expansion which reduces thermal stresses. The annulus design, for the regenerator, can also have the regenerator insulation(12) region between the cylinder(20) and Regenerator(6).

The dome region of the Stirling design is unique in its use of the liquid metal region(4) surrounding the heat transfer tubing(5) and the liquid salt region(33) surrounding the pressure shell assembly(27). The expansion bellows(2) and the outer shell(24) allow the dome region to pressurize to approximately the same pressure as the heat transfer tubing (5) internal pressure. The result is an almost zero stress on the heat transfer tubing(5). This is typically a limiting factor in maximum Stirling temperature. It also means that lower cost materials can be used for the heat transfer tubing(5) due to the lower stresses. The liquid metal chosen depends on operating conditions. High heat transfer materials, such as Sodium, work well for modem Stirling engines for the liquid metal region(4). The use of the heater tube(3) which is central among the heat transfer tubing(5) allows the liquid metal region(4) to efficiently transfer the required heat flux using both conduction and convection transfer mechanisms. (Conduction is heat transfer across two non-moving surfaces which are next to each other. Convection is heat transfer due to a moving fluid past a stationary surface. Convection is typically significantly higher in heat transfer rate than conduction).

The heater tube(3) is designed to carry the pressure differential between the inner liquid metal region(4) and the ambient conditions. A Titanium—Zirconium—Molybdenum alloy(TZM) works well for the heater tube(3). The heater tube(3) can be either a single tube, as shown in FIG. 1, or it can be a group of tubes. The top of the heater tube is a region where a heat source can be inserted. The heat supply can be from a variety of sources, including but not limited to; combustion, heat pipe, thermal siphon, Nuclear, or Solar. The heater tube insulation(38) region is shown separating the inside of the heater tube(3) and the liquid salt region(33). The liquid metal port(39) is used to fill and drain the liquid metal region(4). The heater tube(3) is inserted inside the top of the dome(25) which extends up and attaches to the salt shell(34). The heater tube(3) attaches to the salt shell(34) at the salt shell fitting(51) in the top of the salt shell(34). The attachment of the heater tube(3) to the salt shell fitting(51) can use a brazing attachment which is more tolerant of the expansion mismatches which can occur at this junction. The salt shell cap(52) is attached over the heater tube(3) attachment to help maintain the seal.

Working Fluid Containment

For the engine to function the lower housing(21) is pressurized with a quantity of the working fluid; air, Helium, or Hydrogen. If the output shaft(29) is removed and the crankshaft(17) is connected to a generator or pump, both not shown, by the shaft fitting(32) so that all the rotating systems are inside the lower housing(21) then containing the working fluid is easily accomplished with static seals. In this case the complete lower housing(21) could be filled with the working fluid. If the output shaft(32) is used to produce rotary motion outside of the lower housing(21) then working fluid leakage must be addressed. FIG. 1 shows the working fluid, in this case Helium, in the Helium chamber(15). The Helium chamber(15) has the set of crankshaft end plates(50) located on either side which are fitted with a set of low pressure seals and bearings(31). The low pressure seals are used to isolate the Helium inside the Helium chamber(15). The bearings are used to center the crankshaft(17).

On either side of the Helium chamber(15) are a set of air chambers(16). The air chambers(16) are pressurized to approximately the same pressure as the working fluid. This maintains a low pressure differential on the low pressure seals and prevents the Helium or air from moving across the seals. The output shaft(29) has a high pressure seal and bearing(30) located where the output shaft(29) penetrates the wall of the lower housing(21). The air pump fitting(8) is located in the lower housing(21) wall and is used to pump ambient air into the air chamber(16) if the high pressure seal leaks air. The two air chambers(16) are shown in FIG. 1. The left air chamber(16) could be filled with air or the working fluid. The reason for the left chamber(16) filled with air is to allow for disassembly of the lower housing ends, relative to the helium chamber(15), for bearing lubrication and maintenance.

When the engine is stationary the compressed working fluid will slowly move into the upper cylinder(20) past the piston rings.

Dual Shell Containment System

The dual shell containment system provides a time varying pressure field which matches the working fluid pressure in the cylinder(20) above the power piston(10). The pressure field provides a low pressure differential on the heat transfer tubing(5) so that it can be operated at significantly higher temperature levels; relative to a system which does not have the pressure field matching. To transmit the pressure field from the Helium working fluid to the outside of the heat transfer tubing(5) the liquid salt region(33) is used. The liquid salt region(33) surrounds the Helium working fluid and is separated by the pressure shell assembly(27). The pressure shell assembly(2) consists of the outer shell(24), a dome(25), and an outer flange(13). The outer flange(13) is attached to the salt shell(34). The dome(25) is also attached to the salt shell(34). The combination of the pressure shell assembly(27) and the salt shell(34) completely contain the liquid salt region(33). The outer shell(24) provides a flexible metal surface which transmits the time varying pressure field from the Helium to the liquid salt region(33). The liquid salt region(33) is an approximately incompressible and insulating region which can transmit the pressure forces with minimal fluid motion. An insulating filler material is mixed with the liquid salt to prevent the liquid salt from moving due to thermal gradients within the salt. The dome(25) transmits the pressure field to the liquid metal region(4) which acts as a conducting approximately incompressible fluid. The liquid metal transmits the pressure field to the heat transfer tubing(5). A second method for transmitting the time varying pressure field is shown with the expansion bellows(2). The expansion bellows(2) provides a direct path from the Helium to the liquid metal region(4). The salt port(37) is used to drain and fill the liquid salt region(33). The salt shell(34) and the pressure shell assembly(27) are attached to the bottom of the engine by a series of bolts located inside the set of upper shell attachment fittings(35). The pressure shell assembly(27) is removed from the cylinder(20) at the snug fit joint(14) located at the top of the cylinder(20). The outer shell(24) and the dome(25) are attached to each other with the dome plate(26) which is located above the cylinder(20).

Cooling System

The cooling system, in FIG. 1, is located at the base of the cylinder(20). The cooling system consists of a set of cooling pipes(7) located inside a cooling housing(23). The cooling housing(23) is filled with a cooling liquid such as water. Two cooling fluid ports(9) allow the water to move in and out of the cooling housing(23). The cooling flange(22) is attached from the cooling housing(23) to the cylinder(20). The cooling housing(23) is attached at the bottom edge to the throttle housing(48). A series of lower shell attachment fittings(55) are used to connect the top of the engine with the cooling region using a set of shell bolts(56).

Engine Throttling

The Stirling engine shown, in FIG. 1, is pressurized with a working fluid such as air, Helium, or Hydrogen. Pressurizing the lower housing(21) allows the system to operate without perfect internal seals at the displacer piston(1) and power piston(10). Pressurizing the lower housing(21) also allows a reservoir for the working fluid which can be used to throttle the engine.

The lower cylinder wall(20) is ported with the throttle(28) so that when the power piston(10) is at bottom dead center the throttle ports are completely above the power piston(10) and connect the upper cylinder region to the lower housing (21). As the power piston(10) moves up the cylinder(20) the region above the power piston(10) is sealed and compressed. The start of the sealing is dependent on the throttle port sequence. The stroke is rapid enough that Teflon or Rulon rings are adequate for the two pistons for sealing. Various openings in the throttle(28) allow the working fluid to adjust to the Helium chamber(15) pressure as the power piston(10) rises thus preventing compression in the region above the power piston(10).

The throttle(28) fits around the cylinder(20) with a snug fit so as to provide a seal between the throttle(28) and the cylinder(20). The throttle(28) rotates on a throttle collar(42). The throttle worm gear(43) transmits rotational positioning to the throttle(28) via the throttle control worm(36). The combination of the throttle control worm(36) and the throttle worm gear(43) provide a means to reduce the gearing between the throttle movement and a throttle drive mechanism. The throttle control worm(36) is shown inside the throttle fairing blister(49). The blister provides a pressure fairing to contain the working fluid. The throttle fairing(48) provides a pressure fairing for the throttle. The throttle fairing(48) has a series of throttle vents(44) located at the lower side of the throttle fairing(48) on the surface of the lower housing(21). The set of throttle vents(44) provide a means for the working fluid, Helium, to move from the cylinder(20) into the lower housing(21).

Regenerator Detail

FIG. 2 is a top plan view of a spiral wrapped annular regenerator. The working fluid passes through the gaps between each helix wrap. The ceramic string spacer(58) is used to hold a gap between each wrap of the helix. The ceramic string is shown in three positions around the circumference. The number of ceramic string locations is dependent on the stiffness of a given regenerator and may vary from 0 to several strings.

FIG. 3 is a cross sectional view of the regenerator at the cut location marked 'AA' in FIG. 2. The spiral regenerator is shown schematically as a series of vertical line elements. The ceramic string is shown weaving back and forth through the regenerator sheets.

Throttle Detail

A side elevational view of the throttle ring assembly is shown in FIG. 4. The ring assembly consists of the throttle (28) which has been drilled with groupings of ports(41) arranged so as to provide a stepped series of holes. A blank space separates each grouping of holes around the throttle (28). The throttle(28) functions by rotating around the cylinder(20). The throttle(28) is driven by the throttle worm gear(43) which is attached to the throttle(28). The throttle control worm(36) is shown engaged into the throttle worm gear(43) and provides a step down means so as to improve the positioning accuracy of the throttle(28).

FIG. 5 is a side elevational view of the cylinder throttle assembly. The assembly consists of the cylinder(20) with the throttle collar(42) attached. A series of cylinder ports(40) are drilled into the cylinder(20) and spaced to match the vertical location of holes in the throttle(28). The throttle functions by rotating the throttle(28) through the distance of each grouping of holes. The blank position would provide a complete seal and full throttle conditions. As the throttle(28) is rotated, an increasing number of ports are opened which allow the working fluid to vent from the area above the power piston(10) into the throttle housing(48). The higher the vent ports the more power piston(10) has to travel without compressing the working fluid in the cylinder(20). Once the power piston moves past the holes the compression continues in the cylinder(20) but at a much lower level. This reduction in compression reduces the total power produced. A unique advantage of this system is the complete sealing of the upper cylinder region after the power piston(10) has past the vent holes. The advantage of this new technique is that the engine will operate at a much higher efficiency at partial power than a dead volume throttling system which maintains the increased dead volume over the complete stroke. The reason for this improvement is tied into the Stirling cycle and its working fluid movement. During the power stroke the majority of the working fluid is heated and located above the displacer piston(1). As the power piston(10) gets pushed downward an increase in volume occurs between the displacer piston(1) and the power piston(10). This results in movement of the working fluid from the region above the displacer piston(1). In the new design all of the working fluid moves to the region below the displacer piston(1) and expands against the power piston(10) doing useful work. For the old dead volume system a reservoir is connected to the region between the two pistons. The consequences of the old configuration is that, when the working fluid moves part of the fluid remains in the region above the power piston(1) and does useful work and part of the fluid expands into the dead volume chamber and does zero work. This extra quantity of zero work reduces the total engine efficiency. The new design eliminates the zero work thereby improving the throttle efficiency.

DESCRIPTION AND OPERATION—ALTERNATIVE EMBODIMENTS

Regenerator Variations

The regenerator(6) could be fabricated as the annulus described or it could be made flat and cut into sheets. The individual sheets could be assembled as flat sheets with the fibers running approximately perpendicular to the fluid motion. Concentric cylinders could be used to form the annulus; again with the fibers running approximately perpendicular to the fluid motion. The only critical item for the graphite regenerator is the use of slotted channels for fluid flow and heat transfer. The fiber materials could be carbon, graphite, Boron Carbide, Boron Nitride, or Silicon Carbide or a number of metals such as Tantalum, Molybdenum, or Tungsten. The matrix could be carbon, Boron, ceramic oxides, or Borides. The regenerator could be coated with various surfaces for heat transfer, corrosion protection, or erosion protection. An example of a surface coating would be a thin layer of Boron Carbide, or Boron Nitride, or Silicon Carbide. Other metals or ceramics could be used for the fibers or the matrix. Also a combination of fibers or matrix materials could be used. The regenerator sheets could be porous and tilted a few degrees to the flow so that the flow would have to cross the sheet surface boundaries; flowing through the surface could enhance heat transfer. Other materials with a thermal bias could be used such as graphite plate or other fiber mixes. The regenerator could also be multiple layers of a pure metal sheet.

Variations in Heat Transfer Region

The liquid metal reservoir could be made any shape and volume. The fluid could be any compatible liquid or semi-liquid material; such as a slush or paste. The bellows could be as shown or any shape which applied a pressure to the dome chamber region. The bellows could be two sheets of metal which are sealed on all three sides and attached through the wall of the cylinder. The dome could possibly have a pipe running to the top of the dome region from the top of the cylinder. Some means of preventing the liquid metal from spilling into the pipe, such as a filter, could also work to pressurize the dome. With the stresses on the heat transfer tubes reduced substantially the tubes could be made into flat tubes for increased heat transfer benefits. If the open tube technique was used for pressurizing then the heat transfer tubes could be slightly porous to the working fluid such as carbon tubing which could operate at higher temperatures.

The liquid metal region(4) could be filled with a number of metals, metal alloys or mixtures. These could include, but are not limited to, pure metals and mixtures of Sodium, Potassium, Lithium, Magnesium, Aluminium, Silver, or Copper.

Variations in Liquid Salt Containment System

The liquid salt region(33) could be mixed with a fiber material, such as silica or mullite fibers which prevent the liquid from moving in the salt shell(34). The liquid salt region(33) could also be mixed with a non-melting power, or a series of non-porous or semi-porous sheets.

The liquid salt could be a number of compounds and mixtures which provide an incompressible or semi-incompressible insulating environment. A potential salt mixture could be Silver Chloride and Lead Chloride. The liquid salt technique would be useful for a variety of engines and heat transfer devices which operate at high temperature and pressure. These could include Brayton, Rankine, or Stirling engines.

Variations for Dual Shell Arrangement

Heat transfer designs could be made which have multiple tubes surrounding each heat transfer tube(5). The first tube would be the heat transfer tube(5) which contains the working fluid. The second tube would be a high conductivity flowing liquid such as Sodium. The third tube would be a liquid salt tube. The liquid salt tube could be connected to a region around the dome(25) or the outer shell(24) to provide the time varying pressure field.

System Variations

The dome could be heated directly using solar, flame, Nuclear, Radiation, or chemical heat transfer mechanisms. The heat pipes could stop at the dome surface and help spread the heat internally.

These system improvements would work equally well with multiple cylinder engines and with different Stirling cycles; such as the Rigina cycle where the flow moves to different cylinders during operation.

The pressure shell assembly could be surrounded with a vacuum shell to reduce heat losses. The cooling system could also be built as a finned system for heat dissipation. Spacers could be added between the outer flange and the cooling flange to reduce heat transfer at the junction.

The displacer piston(1) could have a small hole located near the bottom of the piston to maintain the local pressure inside the piston. The piston could also be filled with a fiber insulation.

The lower housing could operate with any number of power output systems.

A possible technique for lubricating the engine is to use a dry Hexagonal Boron Nitride powder. The powder could be allowed to circulate through the upper and lower chambers.

CONCLUSIONS, RAMIFICATIONS, AND SCOPE OF THE INVENTION

While my above description contains many specificities, these should not be construed as limitations on the scope of the invention, but rather as an exemplification of one preferred embodiment thereof. Many other variations are possible.

The dual shell Stirling engine offers significant improvements in efficiency, simplicity, system integration, and cost. The unique dual shell configuration allows higher operating temperatures with resultant efficiency benefits. The unique variable heat transfer annular regenerator offers improved efficiency and power levels. The throttling system is integrated into a reliable, light weight package. The dual chamber shaft seal prevents the escape of primary working fluid significantly enhancing the practicality of the engine.

The individual elements in the patent can be used as a whole unit or as sub-assemblies on new or existing Stirling engine designs. Thus existing engines can benefit from the improvements.

Accordingly, the scope of the invention should be determined not by the embodiments illustrated, but by the appended claims and their legal equivalents.

I claim:

1. A Stirling engine comprising;

a cylinder in which a working fluid is sealed, said cylinder comprising first and second expansion chambers separated by a movable displacer member, said first expansion chamber being connected to at least one heat exchange conduit adapted for moving said working fluid between said expansion chambers, a dual shell pressure sealed vessel forming an inner container adapted to receive heat from an external heat source and filled with a substantially incompressible liquid heat transfer medium surrounding said at least one heat exchange conduit, and an outer container surrounding said inner container and filled with a substantially incompressible thermal insulating liquid, said cylinder having a thin pressure transmission wall exposed to said heat transfer medium to transmit the pressure of said working fluid to said medium, whereby the pressure on the inner and outer surfaces of said heat exchange conduit is substantially equalized to accommodate the time varying pressure gradient of said working fluid, said second expansion chamber being connected to at least one cooling conduit adapted for moving said working fluid between said expansion chambers, a cooling vessel for surrounding said at least one cooling conduit with a cooling medium, a regenerator connected between said conduits providing movement of said working fluid therebetween, whereby heat loss from said heat exchange conduit to said cooling conduit as the working fluid travels from one to the other is minimized, and mechanical means in said second expansion chamber which is driven as a result of movement of and a pressure change in the working fluid.

2. The engine of claim 1 wherein said heat transfer medium comprises a liquid metal, metal alloy or mixture of metals.

3. The engine of claim 2 wherein said liquid metal includes sodium.

4. The engine of claim 2 wherein said outer container is filled with an insulating liquid and a filler material to reduce the movement of the liquid material and increase the thermal insulation effect.

5. The engine of claim 4 wherein said thermal insulating liquid is a molten salt boron anhydride or a boron anhydride and bismuth oxide molten salt mixture.

6. The engine of claim 1 wherein said inner container includes a wall section adapted to transfer heat from an external heat source to said liquid heat transfer medium, said wall section being thermally insulated from said outer container.

7. The engine of claim 1 wherein said regenerator comprises;

at least one heat sink transfer surface constructed and arranged for flow of said working fluid parallel to an in contact therewith in a flow path between said conduits, thereby providing minimum pressure drop said heat sink transfer surface being composed of a material having decreased thermal conductivity in the direction of said flow path and increased thermal conductivity perpendicular thereto.

8. The engine of claim 7 wherein said heat sink transfer surface comprises a fibrous material having significantly increased thermal conductivity in the direction of the longitudinal axis of said fibers, the axis of said fibers being oriented at an angle to said flow path.

9. A Stirling engine comprising;

a cylinder in which a working fluid is sealed, said cylinder comprising first and second expansion chambers separated by a movable displacer member, said first expansion chamber being connected to at least one heat exchange conduit adapted for moving said working fluid between said expansion chambers, a dual shell pressure chamber including an inner container which is adapted to contain a fluid at high temperatures and pressure surrounding said at least one heat exchange conduit and an outer container surrounding said inner container and filled with a substantially incompressible thermal insulating liquid, said second expansion chamber being connected to at least one cooling conduit adapted for moving said working fluid between said expansion chambers, a cooling vessel for surrounding said at least one cooling conduit with a cooling medium, a regenerator connected between said conduits providing movement of said working fluid therebetween, whereby heat loss from said heat exchange conduit to said cooling conduit as the working fluid travels from one to the other is minimized, and mechanical means in said second expansion chamber which is driven as a result of movement of and a pressure change in the working fluid.

10. The engine of claim 9 wherein said inner container is filled with a substantially incompressible thermal conductive non solid material.

11. The engine of claim 10 wherein said thermal conductive material comprises a liquid or semi liquid metal, metal alloys or mixture of metals.

12. The engine of claim 11 wherein said metal includes sodium.

13. The engine of claim 9 wherein said outer container is filled with an insulating liquid and a filler material to reduce the movement of the liquid material and increase the thermal insulation effect.

14. The engine of claim 13 wherein said thermal insulating liquid is a molten salt such as boron anhydride or a molten salt mixture such as boron anhydride and bismuth oxide.

15. The engine of claim 9 wherein said inner container includes a pressure transmitting wall which surrounds said regenerator and is subjected to the pressure of the working fluid therein, and means to transmit the pressure of said working fluid in said first chamber to said inner container, whereby the pressure on the inner and outer surfaces of said heat exchanger conduit is substantially equalized to accommodate the time varying pressure gradient of said working fluid.

16. The engine of claim 9 wherein said regenerator comprises;

at least one heat sink transfer surface constructed and arranged for flow of said working fluid parallel to and in contact therewith in a flow path between said conduits thereby providing minimum pressure drop, said heat sink transfer surface being composed of a material having decreased thermal conductivity in the direction of said flow path and increased thermal conductivity perpendicular thereto.

17. The engine of claim 16 wherein said heat sink transfer surface comprises a fibrous material having significantly increased thermal conductivity in the direction of the longitudinal axis of said fibers, the axis of said fibers being oriented at an angle to said flow path.

18. The engine of claim 17 wherein said mechanical means comprises a reciprocating power piston, said engine including a throttle mechanism comprising;

a pressure sealed reservoir for working fluid, at least one vent opening in said cylinder connecting said second chamber to said reservoir, said vent being located so as to be closed by said piston at a predetermined point during its return compression stroke, the escape of working fluid into said reservoir thereby reducing the compression and power produced, and a throttle control device for selectively regulating the position and cross sectional area of said vent opening to vary the compression and thereby the degree of engine throttling.

19. The engine of claim 18 including;

a crank shaft operatively connected to said power piston, said working fluid reservoir comprising a crank shaft housing including lubricated pressure sealed bearing mounts for said crank shaft, and a pressure sealed buffer housing surrounding said bearing mounts, said buffer housing being pressurized by ambient air pumped from outside said buffer housing, whereby a low pressure differential is maintained between said crank case housing and said buffer housing to minimize working fluid leakage.

20. An insulating high temperature dual shell pressure chamber comprising:

an inner container adapted to contain a fluid which is operating in a time varying high temperature and pressure field, and an outer container which surrounds the inner container and is filled with an insulating liquid and a filler material which occupies the same volume as the liquid material and reduces the movement of the liquid material and increases the thermal insulating effect, whereby said dual shell provides an insulating constant pressure region which reduces the pressure forces on the inner container and allows the outer container to operate at a reduced temperature relative to the inner container.

21. The dual shell pressure chamber of claim 20, wherein the insulating liquid is non-convective.

22. An insulating high temperature dual shell pressure chamber comprising:

an inner container adapted to contain a fluid which is operating in a time varying high temperature and pressure field, and an outer container which surrounds the inner container and is filled with an insulating liquid comprising a boron anhydride molten salt or a boron anhydride and bismuth oxide molten salt mixture, whereby said dual shell provides an insulating constant pressure region which reduces the pressure forces on the inner container and allows the outer container to operate at a reduced temperature relative to the inner container.

23. In a thermal engine having a hollow heat exchange element subjected to a time varying high temperature and pressure field source, a dual shell pressure containment system comprising;

an inner container adapted to receive heat from an external heat source and filled with a substantially incompressible liquid heat transfer medium surrounding said heat exchange element, and an outer container surrounding said inner container and filled with a substantially incompressible thermal insulating liquid.

24. The engine of claim 23 including;

means to transmit pressure from said time varying source to said medium, whereby the pressure on the inner and outer surfaces of said heat exchange element is substantially equalized to accommodate the time varying pressure gradient of said source.

25. The engine of claim 24 wherein said inner container includes a wall section adapted to transfer heat from an external heat source to said medium, said wall section being thermally insulated from said outer container.

26. A method of providing a thermally insulated time varying pressure field which matches the working fluid pressure within the heat exchange conduit of a thermal engine comprising the steps of;

surrounding said conduit with a heat transfer liquid medium contained in a pressure transmitting inner shell, subjecting said medium to the working fluid pressure within said engine, and surrounding said pressure transmitting shell with a thermal insulating liquid contained in a rigid outer shell.

27. The method of claim 26 including the further steps of;

transferring heat from an external source through said medium to the working fluid in said conduits, and thermally insulating said outer shell from said external heat source.

* * * * *